US008141559B2

(12) United States Patent
Branton et al.

(10) Patent No.: US 8,141,559 B2
(45) Date of Patent: Mar. 27, 2012

(54) RELATING TO SMOKING ARTICLE FILTERS

(75) Inventors: Peter James Branton, Southampton (GB); Philip Richard Hunt, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 1163 days.

(21) Appl. No.: 10/563,506

(22) PCT Filed: Jul. 9, 2004

(86) PCT No.: PCT/GB2004/002961

§ 371 (c)(1), (2), (4) Date: Apr. 4, 2006

(87) PCT Pub. No.: WO2005/023026

PCT Pub. Date: Mar. 17, 2005

(65) Prior Publication Data

US 2006/0219253 A1 Oct. 5, 2006

(30) Foreign Application Priority Data

Jul. 10, 2003 (GB) ..... 0316171.8

(51) Int. Cl.
*A24B 15/28* (2006.01)

(52) U.S. Cl. ..... 131/322; 131/329; 131/335; 131/342; 131/360; 131/207

(58) Field of Classification Search ..... 131/365, 131/339, 340, 341, 342, 361
See application file for complete search history.

(56) References Cited

U.S. PATENT DOCUMENTS

| | | | | |
|---|---|---|---|---|
| 3,238,056 | A * | 3/1966 | Pall et al. | 428/338 |
| 3,894,545 | A * | 7/1975 | Crellin et al. | 131/342 |
| 4,846,199 | A * | 7/1989 | Rose | 131/329 |
| 2002/0002979 | A1 * | 1/2002 | Bowen et al. | 131/360 |

FOREIGN PATENT DOCUMENTS

| | | | |
|---|---|---|---|
| EP | 0579410 | * | 1/1994 |
| EP | 0664964 | * | 8/1995 |

* cited by examiner

*Primary Examiner* — Richard Crispino
*Assistant Examiner* — Phu Nguyen
(74) *Attorney, Agent, or Firm* — Charles I. Sherman; Middleton Reutlinger

(57) ABSTRACT

The invention describes a filter (1) with a first filter portion (6) comprising an adsorbent, for example carbon, and/or a catalyst, capable of reducing various vapor phase constituents of cigarette smoke. The adsorbent/catalyst is separated from a second filter portion by means of a barrier (2) having pores therein of pore size less than 0.1 μm. The invention also describes a smoking article in which a rod of smoking material, with or without encapsulated flavor, is attached to the above described filter.

34 Claims, 3 Drawing Sheets

Fig. 6 : Legend: - - - - Maximum concentration in equilibrium; ▪ polypropylene membrane; ♦ polyethylene membrane.

RELATING TO SMOKING ARTICLE FILTERS

CROSS REFERENCE TO PRIOR APPLICATION

This application is a national stage filing (35 U.S.C. 371) of PCT/GB2004/002961, filed on Jul. 9, 2004, which claims priority to and benefit from Great Britain Patent Application No. 0316171.8, filed on Jul. 10, 2003, currently pending.

The present invention relates to smoke filters in particular, but not exclusively, for smoking articles.

Filters capable of removing various components from tobacco smoke and/or improving the taste characteristics of smoke delivered to the consumer have been described in a number of patents.

For example, GB 1 410 048 describes one such filter in which longitudinally extending regions of the filter are separated by a diaphragm of vapour-porous material, preferably a highly porous paper, into at least one region providing a through path for smoke and at least one region which is filled with carbon and which is closed against smoke flow through the carbon. The aim of the filter is to alleviate the adverse effect of carbon on the taste of the tobacco smoke delivered to the consumer.

Previously described filters utilising carbon as an adsorbent for vapour phase constituents of cigarette smoke have aimed to alleviate the "off-taste" provided by that carbon material when a cigarette with a carbon-containing filter is smoked by a consumer.

Methods of alleviating carbon "off-taste" have included coating individual carbon granules with a barrier layer without bonding the granules together. Another method, utilising highly porous paper blocked at both ends by a disc of either plastic or a sealing compound such as polyvinyl acetate adhesive, results in little carbon "off-taste" being delivered to the consumer.

The previously described filters are not concerned with the poisoning of the adsorbent/carbon within the filter. Carbon poisoning may result in reduced adsorption efficiency for the vapour phase constituents of smoke.

In addition, filters, containing discs and the like are difficult and costly to manufacture at the high speeds required in the cigarette-making industry.

The present invention has as an aim the provision of a smoke filter which is capable of separating the vapour phase and the particulate phase of mainstream cigarette smoke.

When referred to herein "mainstream smoke" shall be taken to mean the smoke leaving the downstream end i.e. the mouth end of the smoking article during the smoking process.

A further aim of the present invention is to provide a smoke filter in which an adsorbent and/or catalyst incorporated therein is protected from poisoning by the particulate phase of smoke, thus, increasing the capability of the adsorbent and/or catalyst for reducing vapour phase constituents of the smoke.

An even further aim of the present invention is to provide a smoke filter which, in combination with a rod of smoking material comprising non-volatile flavour or a flavour stabilised, for example, by encapsulation, prevents poisoning of an adsorbent and/or catalyst in the filter, thus ensuring maximum adsorbent activity and flavour yield.

It is also an aim of the present invention to provide a smoke filter which is relatively simple and cheap to manufacture at the high speeds required in the cigarette-making industry.

The present invention provides a smoke filter comprising a first portion and a second portion, said first portion being closed against particulate material flow and said second portion providing a through path for particulate material flow, said first portion and said second portion being separated by barrier means, said barrier means having pores therein, which pores have a pore size of less than about 0.1 μm.

Advantageously the barrier means is porous to the vapour phase of smoke, and may be formed from a flexible or a rigid material. Advantageously the barrier means may be formed from a vapour porous polymeric material. Preferably the polymeric material may be selected from the group consisting of polypropylene, polyethylene, polyvinylidene fluoride, polyvinyl chloride, polycarbonate, nylon, Teflon™ (PTFE), cellulose acetate or nitrocellulose. Other suitable polymeric materials will be well known to the skilled artisan. Alternatively the barrier means may be a vapour porous ceramic material. It will be readily apparent to the person skilled in the art that the ceramic barrier material will be relatively rigid in construction. Advantageously the ceramic barrier material will remain relatively impervious to particulate material flow during the smoking process.

In a further alternative the barrier means may comprise a vapour porous paper.

In a first embodiment of the present invention it is much by preference that the first portion of the tobacco smoke filter comprises an adsorbent material. Preferably the adsorbent material is a general adsorbent. The general adsorbent material is preferably selected from a group of relatively high surface area materials, such as activated charcoal, which are capable of adsorbing a range of chemical compounds without a high degree of specificity. Most preferably the general adsorbent is a carbonaceous material such as, for example, activated charcoal, activated coconut carbon, activated coal-based carbon or synthetically derived carbon. Suitably the carbonaceous material may be in the form of a thread, particles/granules, cloth, paper or a reconstituted carbon-containing sheet, or any other suitable form whatsoever. The general adsorbent may alternatively be a non-carbonaceous material such as, for example, zeolite, silica, meerschaum, aluminium oxide or combinations thereof. Other suitable adsorbent materials will be well known in the art.

In a second embodiment of the present invention, the first portion of the smoke filter may comprise a catalyst. Advantageously the catalyst facilitates the conversion of carbon monoxide (CO) to carbon dioxide ($CO_2$) in the vapour phase of the smoke. It is much by preference that the catalyst is highly selective for carbon monoxide. Preferably the catalyst may be one of the group consisting of transition metal oxides, silica, alumina, zeolites, impregnated carbon, for example, carbon impregnated with metals. A third embodiment of the present invention provides a filter wherein the first portion thereof comprises a selective adsorbent. The selective adsorbent material is preferably a material having an affinity for a predetermined class of chemical compounds. The selective adsorbent material is chosen based on the specific smoke constituents targeted for removal from the smoke. Preferably the selective adsorbent may be selected from the group consisting of an ion-exchange resin, such as Duolite™ or amberlite for example, zeolite, silica, or any other suitable selective adsorbent known to the person skilled in the art. Although zeolite and silica may be either general or selective adsorbents it will be apparent to the skilled artisan that these compounds can be physically and/or chemically modified to form a selective adsorbent. For example, a synthetic zeolite containing transition metal ions may be capable of oxidation of smoke constituents such as carbon monoxide, ammonia and/or hydrocarbons, for example.

The alternative embodiments of the present invention may be exclusive of one another or, alternatively, may be combined to provide a filter comprising a first portion, which first portion comprises an adsorbent and a catalyst. Alternatively, the first portion of the filter may comprise a catalyst and a further third portion may comprise an adsorbent. In this alternative arrangement the third portion of the filter is preferably located upstream of the first portion of the filter, i.e. towards the smoking material end thereof. It is much by preference that both the first portion and the third portion are closed to particulate phase flow. Most preferably the third portion of the filter is closed against particulate phase flow by the barrier means described hereinbefore.

Preferably the first portion of the smoke filter, and the third portion (if present), may be a cavity containing an adsorbent and/or catalyst or, alternatively, may comprise a conventional smoke filtration material having an adsorbent and/or catalyst dispersed therein.

Advantageously the adsorbent is capable of retaining at least a portion of the vapour phase of smoke.

It is much by preference that the second portion of the smoke filter of the present invention comprises a conventional smoke filtration material. Suitable conventional materials include cellulose acetate, paper, polypropylene and other materials that will be well known to persons skilled in the art and capable of retaining at least a portion of the particulate phase of smoke.

Preferably the first and second portions of the smoke filter of the present invention are arranged in co-axial alignment.

It is much by preference that the first portion forms the inner core and the second portion forms the outer annulus of a core-annulus arrangement of the filter of the present invention. Alternatively the second portion of the filter may form the core and the first portion may form the outer annulus of such an arrangement.

In a further alternative arrangement of the smoke filter of the present invention, the first portion may be formed of a number of discrete, substantially longitudinal segments arranged in co-axial alignment within the second portion of the filter. In the further alternative arrangement, each segment of the first portion will be separated from the second portion by barrier means, and will be closed against particulate phase flow.

Other suitable arrangements may be taken as forming part of the present invention.

In each arrangement of the smoke filter of the present invention the first portion and third portion (if present) of the filter is closed to the through flow of particulate phase material, whereas the second portion of the filter provides a through flow path for particulate phase material. Advantageously, the first portion is closed to the through flow of particulate phase material at the upstream end thereof i.e. the tobacco rod end thereof. Closure of the first portion may suitably be achieved by a plug. Advantageously the plug may be formed from any material through which the particulate phase of tobacco smoke cannot pass. Preferably the plug is formed from a high pressure drop cellulose acetate, plastic, metal or the barrier material described hereinabove. Other materials suitable for use as a plug will be readily appreciated by a person skilled in the art.

The smoke filter of the present invention may further comprise additional portions of conventional smoke filtration material. For example, the first, second and third (if present) portions may be in co-axial alignment with one, or more, additional filter portions. Preferably the additional portions of the filter are in end-to end abutment with the first, second and third (if present) portions of the filter. The additional portions may suitably be comprised of cellulose acetate, for example.

Suitably the filter of the present invention may be wrapped in a plug wrap. In addition, the filter may be attached to a rod of smoking material by means of a tipping wrapper. It is much by preference that the tipping wrapper is ventilated by means of ventilation holes therein. Advantageously the tipping wrapper is a paper.

The present invention further provides a smoking article comprising a smoke filter of the present invention in combination with a rod of smoking material wrapped in a wrapper. Preferably the wrapper is a paper. Types of paper suitable for use in a smoking article of the present invention will be readily known to the skilled artisan.

Preferably the rod of smoking material comprises tobacco. Alternatively, or in addition, the smoking material may comprise a tobacco substitute material.

The present invention even further provides a smoking article comprising a smoke filter of the present invention in combination with a rod of smoking material wrapped in a wrapper, the smoking material comprising a flavourant.

Advantageously the flavourant is in stabilised or encapsulated form. Alternatively, the flavourant may be a non-volatile flavourant. When used for tobacco products, essential oils, natural extracts and blended flavour formulations are particularly suitable flavourants. Particularly suitable for use in the tobacco industry are, for example, menthol, vanillin, benzaldehyde, cinamaldehyde, furaneol, herb oils, spice oils and citrus oils. Most preferably the flavourant is menthol.

Flavourants suitable for inclusion in a smoking article of the present invention may be stabilised or encapsulated by any appropriate means. Stabilisation of flavourants for incorporation into a smoking article of the present invention may be achieved, for example, by means of the methods described in European Patent 0840 555 or European Patent 110 5006, both of which are incorporated herein by reference.

During smoking of a smoking article of the present invention mainstream smoke, including a vapour phase and a particulate phase, is drawn into the upstream end of the smoke filter. The mainstream smoke is drawn through the second portion of the smoke filter. The vapour phase of the mainstream smoke diffuses through pores in the barrier means into the first portion of the smoke filter wherein various components of the vapour phase are adsorbed and/or catalysed by the adsorbent and/or catalyst within the first portion of the filter. The remaining vapour phase and particulate phase is drawn into the mouth of the consumer through the downstream end of the smoke filter.

It is much by preference that the ventilation level of the smoke filter is such that the vapour phase of the mainstream smoke has a residence time within the filter that enables the diffusion thereof into the first portion of the smoke filter. Suitable ventilation levels and smoke flow rates through the smoke filter will be readily derivable by the person skilled in the art by routine experimentation. The provision of ventilation in the smoke filter of the present invention decreases the flow rate of the mainstream smoke through the filter. Ventilation also serves to dilute the mainstream smoke with air during the smoking process. A reduced flow rate and dilution of the mainstream smoke increase the efficiency of an adsorbent and/or catalyst within the smoke filter.

In order that the present invention be clearly understood and readily carried into effect, reference will now be made, by way of example, to the following examples and diagrammatic drawings, in which.

Figure 1:
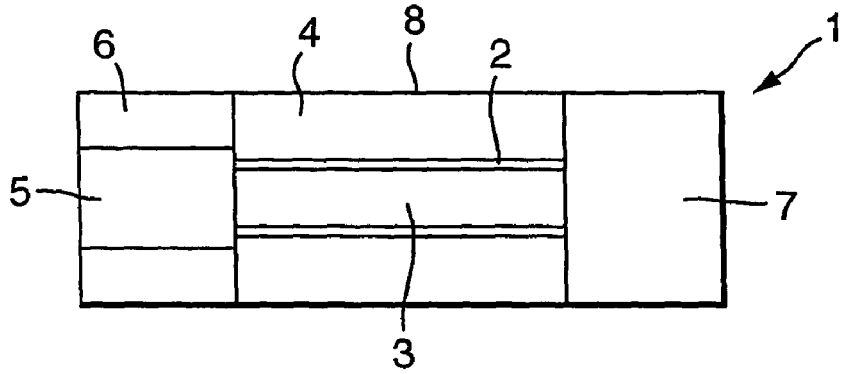
FIG. 1 shows a longitudinal, cross-sectional representation of a filter according to the present invention.

FIG. 1 shows a smoke filter 1 in accordance with a first embodiment of the present invention. Tobacco smoke filter 1 is formed from a co-axial, core-annulus arrangement in which a first portion 3 forms the core and a second portion 4 forms the annulus of the arrangement. First portion 3, comprising an adsorbent and/or a catalyst (not shown), is separated from the second portion 4 by barrier means 2. The barrier means 2 is formed from a polymeric membrane having pores therein of pore size less than about 0.1 μm. The smoke filter 1 of FIG. 1 further comprises a plug 5, which plug 5 is formed from a high pressure drop cellulose acetate material. The high pressure drop cellulose acetate material is of a pressure drop sufficient to render the section substantially impervious to particulate phase material. Plug 5 is in co-axial alignment with the first portion 3 and the second portion 4. Plug 5 is preferably substantially impermeable to the particulate phase of mainstream tobacco smoke, thus closing first portion 3 to the through flow of the particulate phase.

In the arrangement shown in FIG. 1 upstream filter portion 6 forms an annulus around plug 5, the annulus providing a through path for mainstream smoke flow. Downstream filter portion 7 is an optional additional filter segment which provides the filter 1 with a mouth-end that is aesthetically acceptable to consumers. Downstream filter portion 7, and upstream filter portion 6 are formed from a conventional tobacco smoke material such as, for example, cellulose acetate.

In a smoking article of the present invention, the filter 1 is attached to a rod of smoking material wrapped in a wrapper (not shown) by a tipping wrapper (8). In addition, the filter 1 may optionally be wrapped in a plug wrap (not shown). The filter 1 is ventilated by ventilation holes (not shown) in the tipping wrapper 8. In order to provide ventilation holes, the tipping wrapper 8 may be pre-perforated or, alternatively, may be perforated on-line by means of a laser, for example.

During smoking of the smoking article of the present invention, mainstream smoke comprising a particulate phase and a vapour phase is drawn, by the consumer, through the rod of smoking material into the upstream end of tobacco smoke filter 1. Plug 5 is impervious to the particulate phase, therefore, the mainstream smoke will be drawn through upstream filter portion 6 as a path of lower resistance. The mainstream smoke is drawn into second portion 4, wherein the vapour phase of the mainstream smoke diffuses into first portion 3 through barrier means 2. Barrier means 2 prevents the passage of particulate phase into first portion 3.

First portion 3, containing an adsorbent and/or a catalyst (not shown) will selectively remove or reduce various constituents of the vapour phase of the mainstream smoke. The particulate phase and remaining vapour phase will be drawn into downstream filter portion 7 and finally into the mouth of the consumer.

In the Figures like reference numerals have been used to designate features in common.

Figure 2:
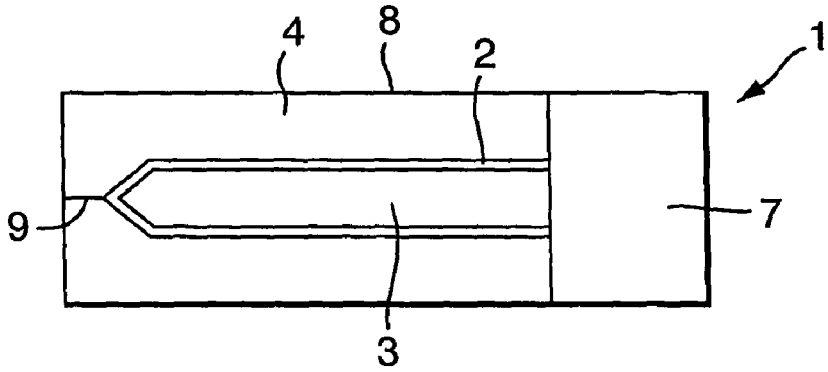
FIG. 2 shows a longitudinal, cross-sectional representation of an alternative arrangement of a filter according to the present invention.

FIG. 2 shows a filter according to an alternative arrangement of the present invention. The smoke filter 1 has a first portion 3 containing an adsorbent and/or a catalyst, which first portion 3 is separated from the second portion 4 by barrier means 2. Barrier means 2 is a polymeric membrane containing pores of pore size 0.1 μm. The polymeric membrane is crimped at an upstream end 9 thereof, thus closing the first portion 3 against through flow of the particulate phase of smoke. The filter 1 shown in FIG. 2 also has a downstream filter portion 7. The filter 1 is optionally wrapped in a plug wrap (not shown) and a tipping wrapper 8 for attachment of the filter 1 to a rod of smoking material wrapped in a wrapper (not shown).

Figure 3:
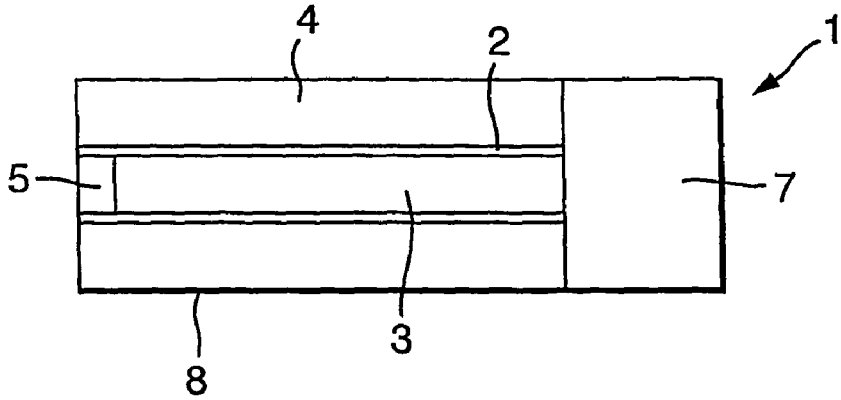
FIG. 3 shows a longitudinal, cross-sectional representation of a further alternative arrangement of a filter according to the present invention.

FIG. 3 shows a further alternative arrangement of a filter according to the present invention. The filter 1 has all of the features of the filter shown in FIG. 2, however, the polymeric membrane 2 is not closed against through flow of particulate material by crimping thereof. Instead, plug 5 is located in the upstream end of the first portion 3 so as to close same against through flow of particulate material.

Figure 4:
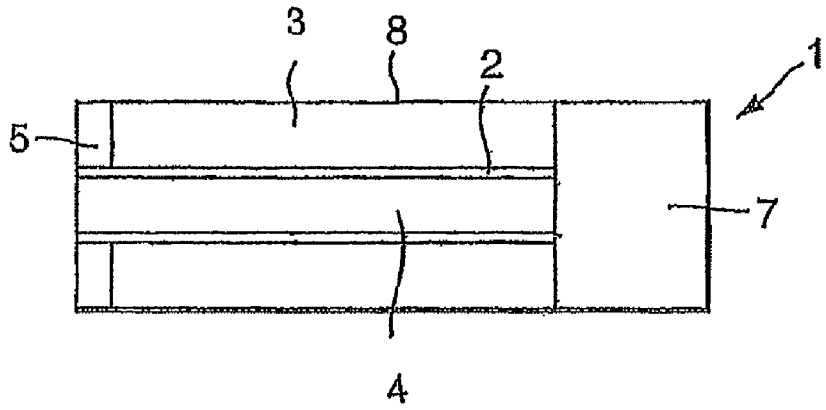
FIG. 4 shows a longitudinal, cross-sectional representation of an even further alternative arrangement of a filter according to the present invention.

FIG. 4 shows a yet further alternative arrangement of a filter according to the present invention. The filter 1 shown in FIG. 4 is an inverse arrangement of the filter shown in FIG. 3. The first portion 3 of the filter 1 forms an annulus around second portion 4, the core section and annulus section being separated by a polymeric membrane 2. The first portion is closed at the upstream end thereof against the through flow of particulate material by plug 5. Plug 5 forms an annular ring around second portion 4, whereby particulate material has a through flow path provided by second portion 4. Vapour phase material diffuses outwardly into the first portion 3.

Figure 5:
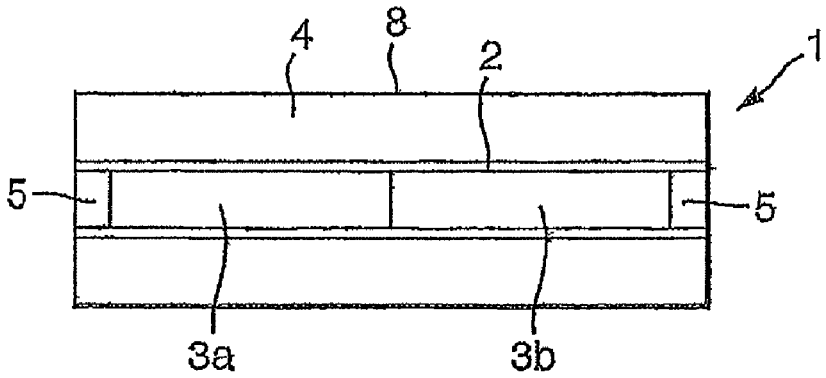
FIG. 5 shows a longitudinal, cross-sectional representation of a further alternative arrangement of a filter according to the present invention.

FIG. 5 shows a further alternative arrangement of a filter according to the present invention. The smoke filter 1 has a first portion 3 containing an adsorbent and a catalyst. First portion 3 may be a cavity containing adsorbent and catalyst or, alternatively, first portion 3 may be comprised of a cellulose acetate material having catalyst or adsorbent dispersed therein. In the arrangement shown in FIG. 5, adsorbent is contained in a first segment 3*a* of first portion 3 and catalyst is contained in a second segment 3*b* of first portion 3. First portion 3 is separated from the second portion 4 by barrier means 2. In the arrangement shown first segment 3*a* of first portion 3 is located upstream of second segment 3*b* of first portion 3. It will be readily apparent to the skilled artisan that the second segment 3*b* may alternatively by located upstream of first segment 3*a*.

First segment 3*a* and second segment 3*b* are preferably in end-to-end abutment and have substantially similar circumferences. Advantageously barrier means 2 is common to both first segment 3*a* and second segment 3*b*.

Barrier means 2 is a polymeric membrane containing pores of pore size of 0.1 μm. Plugs 5 are located in the upstream and downstream ends of first portion 3 so as to close same against through flow of particulate material.

Figure 5A:
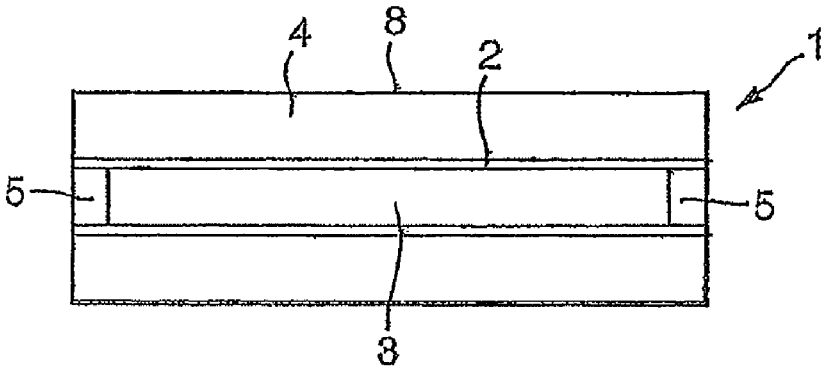
FIG. 5A shows a longitudinal, cross-sectional representation of a further alternative arrangement of a filter according to the present invention.
Figure 6:
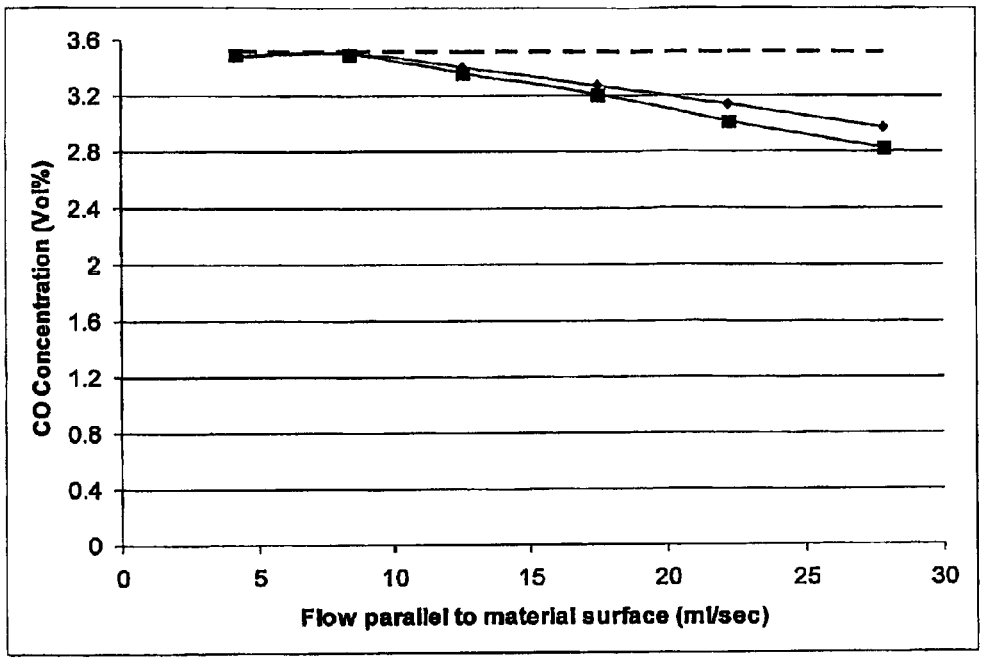

FIG. 5A shows a yet further arrangement of a filter according to the present invention. The smoke filter 1 has a first portion 3 containing an adsorbent and a catalyst intermixed with one another. First portion 3 is a cavity containing intermixed adsorbent and catalyst. In an alternative arrangement first portion 3 may be comprised of a cellulose acetate material having catalyst and adsorbent dispersed therein. First portion 3 is separated from the second portion 4 by barrier means 2. Barrier means 2 is a polymeric membrane containing pores of pore size 0.1 μm. Plugs 5 are located in the upstream and downstream ends of first portion 3 so as to close same against through flow of particulate material.

The smoke filter 1 of FIGS. 5 and 5A is optionally wrapped in a plug wrap (not shown) and a tipping wrapper 8 for attachment of the smoke filter 1 to a rod of smoking material wrapped in a wrapper (not shown).

A smoke filter 1 in the arrangement shown in FIG. 5 may, for example, have a catalyst loading of 200 mg and an activated carbon loading of 50 mg. It will be readily understood by the skilled artisan that the loading level of the material used will depend upon the density of said material and the length of the relevant section used in smoke filter 1. An example of a suitable configuration based upon FIG. 5 is a smoke filter 1 having a total length of 27 mm. Plugs 5 are each 6 mm in length, first portion 3 is 15 mm in length and second portion 4 is 27 mm in length. In an alternative arrangement of the smoke filter 1 of FIG. 5, first portion 3 contains only activated carbon at a loading level of, for example, 100 mg.

In any of the arrangements described above the adsorbent may be activated carbon. The catalyst described in the above arrangements may be one of transition metal oxides, silica, alumina, zeolites, impregnated carbon, for example, carbon impregnated with metals.

In order to demonstrate that diffusion of small molecules, for example carbon monoxide molecules, will occur through the barrier means at the flow rates encountered during the smoking process a diffusion cell may be used as is described in Example 1.

A diffusion cell is provided in which the barrier means of the present invention are positioned in the cell such that the barrier means provides longitudinal separation of two portions of the cell into segments A and B. Gas is supplied independently to Segment A and Segment B through gas inflow conduits C and D respectively. The gas supplied to segment B is an inert gas such as nitrogen, for example. The gas mixture supplied to segment A will contain a volume percentage of a test gas such as carbon monoxide, for example. The concentration of gas exiting each segment through exhaust conduits E and F respectively is measured as a volume percentage (Vol %) of a test gas which is supplied to segment A through gas flow conduit C.

In order to ensure that it is diffusion across the barrier means that is measured the pressure differential ($\Delta P$) across the barrier means is advantageously approximately zero.

The gas supplied to segment B through conduit D and the gas mixture supplied to segment A through conduit C is supplied at a flow rate F. According to the International Standards Organisation (ISO) the standard smoking conditions require a 35 ml puff volume of 2 seconds puff duration to be taken at 60 second intervals. Therefore, the flow rate F of mainstream smoke under ISO smoking conditions is 17.5 $mls^{-1}$.

EXAMPLE 1

Nitrogen gas was supplied to segment B and a mixture of the nitrogen gas and carbon monoxide was supplied to segment A at a flow rate F of between 5 $mls^{-1}$ and about 30 $mls^{-1}$. In this example a mixture of 93% nitrogen with 7% carbon monoxide was supplied to segment A.

The pressure differential $\Delta P$ across the barrier means was approximately 0.25 mmWG, (wherein "mmWG" is "mmWater Gauge"). A pressure differential of 0 ensures that any concentration difference in the test gas, in this case carbon monoxide, is due wholly to diffusion thereof across the barrier means. The gaseous outflow of test gas from segment B was measured by a test gas detector being positioned in exhaust conduit F.

In this example two different barrier means were compared, the first being a polypropylene membrane with a pore size of less than about 0.1 μm, the second membrane being a polyethylene membrane with a pore size of less than about 0.1 μm. The results of the diffusion of carbon monoxide across the barrier means from segment A to segment B is shown in Graph 1 below. The y-axis shows the concentration of carbon monoxide as a Volume percentage (Vol %) as measured from the gaseous outflow of segment B.

It is apparent from Graph 1 that at low flow rates (<10 $mls^{-1}$) almost ideal diffusion behaviour was observed for carbon monoxide wherein the concentration of carbon monoxide measured in exhaust conduit F i.e. exiting segment B was approximately half of the concentration of test gas supplied to segment A through conduit C. At higher flow rates diffusion becomes only slightly less efficient across the barrier means.

The invention claimed is:

1. A smoke filter comprising a first portion and a second portion, said first portion being closed against particulate material flow and said second portion providing a through path for particulate material flow, said first portion and said second portion being separated by barrier means, said barrier means formed from a membrane of vapour porous polymeric material having pores therein, which pores have a pore size of less than about 0.1 μm, wherein said first portion forms a core and said second portion forms an outer annulas of a core-annulas arrangement and wherein said first and said second portions are in coaxial alignment.

2. A smoke filter according to claim 1, wherein the barrier means is porous to the vapour phase of smoke.

3. A smoke filter according to claim 1, wherein said barrier means is formed from a flexible material.

4. A smoke filter according to claim 1, wherein said polymeric material is selected from the group consisting of polypropylene, polyethylene, polyvinylidene fluoride, polyvinyl chloride, polycarbonate, nylon, Teflon™ (PTFE), cellulose acetate or nitrocellulose.

5. A smoke filter according to claim 1, wherein said first portion of the tobacco smoke filter comprises an adsorbent material.

6. A smoke filter according to claim 5, wherein said adsorbent material is a general adsorbent.

7. A smoke filter according to claim 6, wherein said general adsorbent is a carbonaceous material.

8. A smoke filter according to claim 7, wherein said carbonaceous material is in the form of a thread, particles/granules, cloth, paper or a reconstituted carbon-containing paper.

9. A smoke filter according to claim 6, wherein said general adsorbent is a non-carbonaceous material selected from the group consisting of zeolite, silica, meerschaum, aluminum oxide or combinations thereof.

10. A smoke filter according to claim 1, wherein said first portion of said smoke filter comprises a catalyst.

11. A smoke filter according to claim 10, wherein said catalyst facilitates the conversion of carbon monoxide (CO) to carbon dioxide ($CO_2$) in the vapour phase of the smoke.

12. A smoke filter according to claim 11, wherein said catalyst is selected from the group consisting of transition metal oxides, silica, alumina, zeolites, impregnated carbon.

13. A smoke filter according to claim 1, wherein said first portion of said smoke filter comprises a selective adsorbent.

14. A smoke filter according to claim 13, wherein said selective adsorbent material is selected from the group consisting of an ion-exchange resin, zeolite or silica.

15. A smoke filter according to claim 1, wherein said first portion comprises an adsorbent and a catalyst.

16. A smoke filter according to claim 1, wherein said filter further comprises a third portion, which third portion comprises an adsorbent.

17. A smoke filter according to claim 1, wherein said second portion of said filter comprises a conventional smoke filtration material.

18. A smoke filter according to claim 17, wherein said conventional smoke filtration material is one or more of cellulose acetate, paper and polypropylene.

19. A smoke filter according to claim 1, wherein said first portion forms an inner core and said second portion forms an outer annulus of a core-annulus arrangement.

20. A smoke filter according to claim 1, wherein said first portion is formed of a number of discrete, substantially longitudinal segments arranged in co-axial alignment within said second portion of said filter.

21. A smoke filter according to claim 20, wherein each segment of said first portion is separated from said second portion by barrier means.

22. A smoke filter according to claim 1, wherein said first portion is closed to the through flow of particulate phase material at the upstream end thereof.

23. A smoke filter according to claim 22, wherein closure of said first portion is achieved by a plug.

24. A smoke filter according to claim 23, wherein said plug is formed from a material selected from the group consisting of a high pressure drop cellulose acetate, polypropylene, polyethylene, polyvinylidene fluoride, polyvinyl chloride, polycarbonate, nylon, Teflon™ (PTFE), nitrocellulose, plastic or metal.

25. A smoke filter according to claim 1, wherein said filter further comprises additional portions of conventional smoke filtration material.

26. A smoke filter according to claim 1, wherein at least said first and second portions are in co-axial alignment with at least one additional filter portion.

27. A smoke filter according to claim 26, wherein said at least one additional portion of said filter is in end-to-end abutment with said first and second portions of the filter.

28. A smoke filter according to claim 25, wherein said additional portions are comprised of cellulose acetate.

29. A smoking article comprising a smoke filter according to claim 1 in combination with a rod of smoking material wrapped in a wrapper.

30. A smoking article according to claim 29, wherein said smoking material comprises a flavourant.

31. A smoking article according to claim 30, wherein said flavourant is in stabilized or encapsulated form.

32. A smoking article according to claim 30, wherein said flavourant is a non-volatile flavourant.

33. A smoke filter comprising a first portion and a second portion, said first portion being closed against particulate material flow and said second portion providing a through path for particulate material flow, said first portion and said second portion being separated by barrier means, said barrier means is formed from a vapour porous polymeric material having pores therein, which pores have a pore size of less than about 01 .μm, wherein said filter further comprises a third portion, which third portion comprises an adsorbent and wherein said third portion is located upstream of said first portion of the filter.

34. A smoke filter, comprising a first portion and a second portion, said first portion being closed against particulate material flow and said second portion providing a through path for particulate material flow, said first portion and said second portion being separated by barrier means, said barrier means is formed from a vapour porous polymeric material having pores therein, which pores have a pore size of less than about 0.1 μm and wherein said second portion forms a core and said first portion forms an outer annulus of a core-annulus arrangement and wherein said first and said second portions are in coaxial alignment.

* * * * *